73-151 SR
3/26/85 XR 4,507,055

United States Patent [19]

Fair et al.

[11] Patent Number: 4,507,055

[45] Date of Patent: Mar. 26, 1985

[54] SYSTEM FOR AUTOMATICALLY CONTROLLING INTERMITTENT PUMPING OF A WELL

[75] Inventors: John C. Fair, Allison Park, Pa.; Kenneth R. Ferguson, Lafayette, La.

[73] Assignee: Gulf Oil Corporation, Pittsburgh, Pa.

[21] Appl. No.: 514,621

[22] Filed: Jul. 18, 1983

[51] Int. Cl.[3] ..... F21B 43/12; F04B 49/02; F04B 49/06

[52] U.S. Cl. ..... 417/12; 417/53; 73/151

[58] Field of Search ..... 417/12, 38, 53; 73/151

[56] References Cited

U.S. PATENT DOCUMENTS

| | | | |
|---|---|---|---|
| 2,456,456 | 12/1948 | Smith . | |
| 2,550,093 | 4/1951 | Smith . | |
| 2,697,984 | 12/1954 | Pankratz . | |
| 3,091,179 | 5/1963 | Echols . | |
| 3,218,977 | 11/1965 | Scarth . | |
| 3,269,320 | 8/1966 | Tilley et al. | 417/63 |
| 3,276,977 | 10/1966 | Stevensen . | |
| 3,851,955 | 12/1974 | Mills . | |
| 3,854,846 | 12/1974 | Douglas . | |
| 3,918,843 | 11/1975 | Douglas et al. . | |
| 3,936,231 | 2/1976 | Douglas . | |
| 3,951,209 | 4/1976 | Gibbs | 166/250 |
| 3,965,983 | 6/1976 | Watson . | |
| 3,972,648 | 8/1976 | Sangster . | |
| 4,034,808 | 7/1977 | Patterson | 166/65 R |
| 4,118,148 | 10/1978 | Allen . | |
| 4,125,163 | 11/1978 | Fitzpatrick . | |
| 4,311,438 | 1/1982 | Comstedt . | |
| 4,390,321 | 6/1983 | Langlois | 417/15 |

*Primary Examiner*—William L. Freeh
*Attorney, Agent, or Firm*—Deane E. Keith; Forrest D. Stine; Richard C. Gaffney

[57] ABSTRACT

A system for automatically controlling the intermittent pumping of a well minimizes fluid pound occurrence without reducing well production. The pump is operated in a learn mode until pump-off of the well when the pump is deactivated for a preset period. The pump is then operated in a control mode in which the pump is repeatedly cycled on to pump the well for at least one stroke less than the pumping time of the learn mode and then off for a preset period. Control mode operation is continued for a predetermined number of cycles after which the learn mode operation is repeated to reset the pumping time for the control mode operation.

14 Claims, 14 Drawing Figures

IF $|T_2-T_1|<T_K$, SET $T_O$
AT LEAST OF $(T_1, T_2)$-1 OR 2
PUMP STROKES

PUMPING TIME FLUCTUATIONS FOR DIFFERENT DOWN TIME

EFFECT OF DOWN TIME ON THE PRODUCTION COEFFICIENT

SYSTEM FOR AUTOMATICALLY CONTROLLING INTERMITTENT PUMPING OF A WELL

BACKGROUND OF THE INVENTION

1. Field of the Invention

This invention relates to a system for automatically controlling the intermittent pumping of a well. More particularly, the present invention relates to a control system which automatically deactivates the pump for a preset period just prior to an expected fluid pound, reactivates the pump, and automatically readjusts the pumping time after a predetermined number of cycles in a control mode.

2. Description of the Prior Art

Many wells, particularly oil wells, employ a reciprocating pump installed generally adjacent the fluid level of the reservoir being pumped such that the lower end of the pump is submerged. The pump comprises a plunger which is connected to a drive mechanism through a sucker rod extending upwardly through the well and out a wellhead at the upper end of the well. At its upper end, the sucker rod is coupled to a beam-type pumping unit driven by an electric motor or internal combustion engine.

Initially, a pump is operated continuously because of the volume of the oil in the underground reservoir penetrated by the well. After the initial operating period, the reservoir is partially depleted to an extent that the maximum pumping capacity of the pump is greater than the flow of fluid into the bore hole of the well from the reservoir. The pump is then operated intermittently to compensate for the reduced flow into the bore hole.

The intermittent operation of the pump should be controlled to avoid a "pump-off" condition and fluid pound caused by the pump-off condition. Additionally, the controlled cycling of the pump should maximize well production and pump efficiency. When a well is in a pump-off condition or is over-pumped, the fluid level in its annulus falls to a point such that the pump only is partially filled with fluid during the upstroke of its operation. During the downstroke, the movable portion of the pump (pump plunger or travelling valve) will hit the fluid surface causing a fluid pound. The fluid pound causes compression and strain waves in the sucker rod, repeated occurrence of which can cause premature failure of the rod pumping equipment. The reduced flow during the pump-off condition also reduces the efficiency of the pumping mechanism.

Numerous systems have been developed for sensing the pump-off condition and then turning off the pump. The pump-off detection methods involve sensing motor current, annulus fluid level, vibration of the rod string, polished rod load fluctuations and motor or polished rod power fluctuations.

The system which monitors the polished rod load is the preferred means of detecting fluid pound. Such system comprises a strain gauge transducer fixed to the walking beam of the pump unit for detecting changes in the polished rod load through deflections in the walking beam. The sensor transducer transmits a signal proportional to the load on the rod during a predetermined, early portion of the pump-down stroke. During a pump-off condition, the load on the rod is increased when compared to that of normal pump operation. Thus, if the load on the rod is over a predetermined amount, the pumping unit is shut down for a preset down time. A typical example of this type of pump-off control is disclosed in U.S. Pat. No. 3,851,995 to Mills.

Such pump-off control systems are disadvantageous since actuation requires the occurrence of a fluid pound. Thus, such systems cause the pump unit to be subjected to the fluid pound stresses prior to deactivation, rather than anticipating the occurrence of a pump-off conditon or fluid pound and deactivating the pump prior to such occurrence.

U.S. Pat. No. 2,456,456 to Smith discloses a system for setting optimum pumping and pump down times. Such system involves operating the pumping equipment for a time greater than that necessary to deplete the fluid in the well while recording the energy consumption of the pumping equipment. After the pump has been shut down for an arbitrary time period, the pumping and recording steps are repeated. From the records generated, the optimum pumping and shut down times are determined such that the well can be adjusted for automatic pumping operation according to the calculated optimum times.

In another system disclosed in U.S. Pat. No. 4,311,438 to Comstedt, the intermittent operation of a well pump is controlled by a pump-off control which shuts the pump down upon sensing the pump-off condition. The running time of the pump is measured and used to vary the subsequent down time of the pump. A long running time results in a short down time, while a short running time gives a long down time.

Conventional systems for automatically controlling intermittent pumping operations are disadvantageous in that they do not operate the pump at a sufficiently high efficiency level and/or do not adequately avoid the occurrence of fluid pounds. Inefficient pump operation wastes engergy in operating the pump and reduces output of the well. By failing to avoid the occurrence of fluid pound, the pumping mechanisms controlled by the conventional systems tend to suffer a higher failure rate.

SUMMARY OF THE INVENTION

It has now been discovered that the disadvantages associated with the use of conventional systems for automatically controlling intermittent pumping of a well are eliminated by operating in a learn mode to determine when fluid pounds are expected to occur, and then controlling the pump to cycle on and off to avoid the fluid pounds for a predetermined number of cycles. After the predetermined number of cycles, the learn mode is repeated.

More specifically, the system of the present invention involves controlling the intermittent pumping of a well by a pump wherein the pump is operated in a learn mode by pumping the well during at least two test runs until the well is in a pump-off condition, deactivating the pump for a preset period after each test run, and comparing the difference between the two runs to a preset tolerance. If the difference is within the tolerance, the pump will be operated in the control mode. However, if the difference is greater than the tolerance, the pump is operated through another test run until the difference between the last two test runs is within the preset tolerance. The use of two test runs in the learn mode avoids improper setting of the pumping time for the control run which can be caused, for example, by gas lock.

After the learn mode, the pump is operated in a control mode in which the pump is repeatedly cycled on to pump the well for at least one stroke less than the learn mode run, and then off for a preset period. Cycling of the pump in the control mode is continued for a predetermined number of cycles, after which operation of the learn mode is repeated to reset the pumping time for subsequent control mode operation.

By controlling the intermittent pumping of the well in this manner, the occurrence of fluid pound is significantly reduced, the energy consumption of the pumping mechanism is minimized and the output of the well is maximized. Fluid pound occurrence is minimized by shutting the well down in the control mode immediately prior to the expected occurrence of fluid pound and by testing the well periodically to determine when fluid pound should be expected. Since the pump mechanism is operated while there is adequate fluid in the bore hole, the pump mechanism is only operated at its maximum efficiency. The repeated testing and resetting of the pumping time for the control mode also changes the pumping time depending on the fluid flow into the bore hole to achieve maximum output of the well with minimum expenditure of energy to drive the pumping mechanism and minimum wear on the pumping mechanism.

During the control mode, the pump operation can be continuously monitored to sense a pump-off condition and to deactivate the pump for a preset time upon sensing the pump-off condition. Continued monitoring of the pump operation will prevent damage to the pump which would otherwise be caused by unexpected fluid pound. After sensing an unexpected fluid pound, the learn mode can be repeated to reset the control mode pumping time as necessary to compensate for any change of flow into the bore hole. Preferably, the sensing of the pump-off condition of the well is detected by monitoring the polished rod load fluctuations in a sucker rod pump.

Other advantages and salient features of the present invention will become apparent from the following detailed description which, taken in conjunction with the annexed drawings, discloses a preferred embodiment of the present invention.

DETAILED DESCRIPTION OF THE PREFERRED EMBODIMENT OF THE INVENTION

Figure 1:
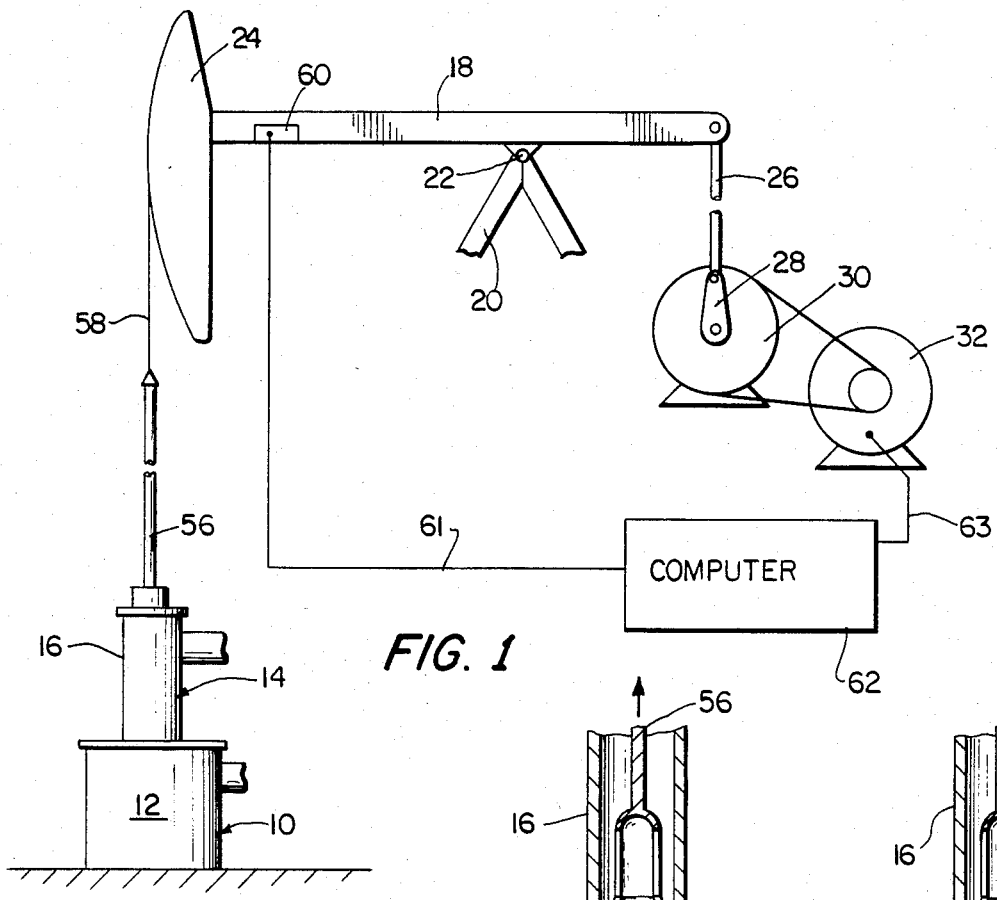
FIG. 1 is a schematic illustration of a control system for automatically controlling the intermittent pumping of a well by a pump in accordance with the present invention.

Referring initially to FIG. 1, well 10 has a casing 12 extending downwardly into the earth and into a sub-surface reservoir. Adjacent the reservoir, casing 12 is perforated to permit the reservoir fluids to flow into the well. A suitable wellhead 14 supports the well tubing 16, closes the top of the annulus between the tubing and casing 12, and conveys the fluid pumped from the well in accordance with conventional practice.

The pumping mechanism for the well comprises a walking beam 18 pivotally mounted on a frame 20 by a bearing 22. A horse head 24 is mounted on one end of beam 18 directly over wellhead 14. The opposite end of walking beam 18 is coupled by pitman 26 to a crank 28 rotated by a speed reducer 30. The speed reducer is driven by a prime mover or motor 32 which can comprise, for example, an electric motor or an internal combustion engine.

Figure 2:
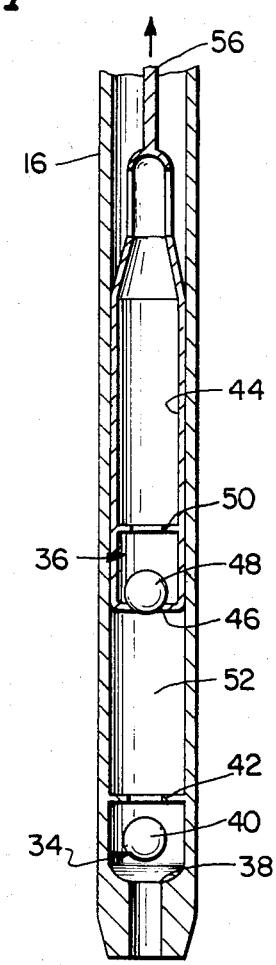
FIGS. 2 and 3 are partial, graphic illustrations of the down hole pumping mechanism during upstroke and downstroke, respectively.
Figure 3:
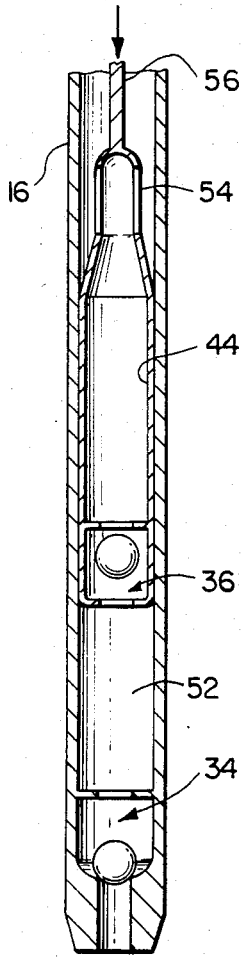
Figure 4A:
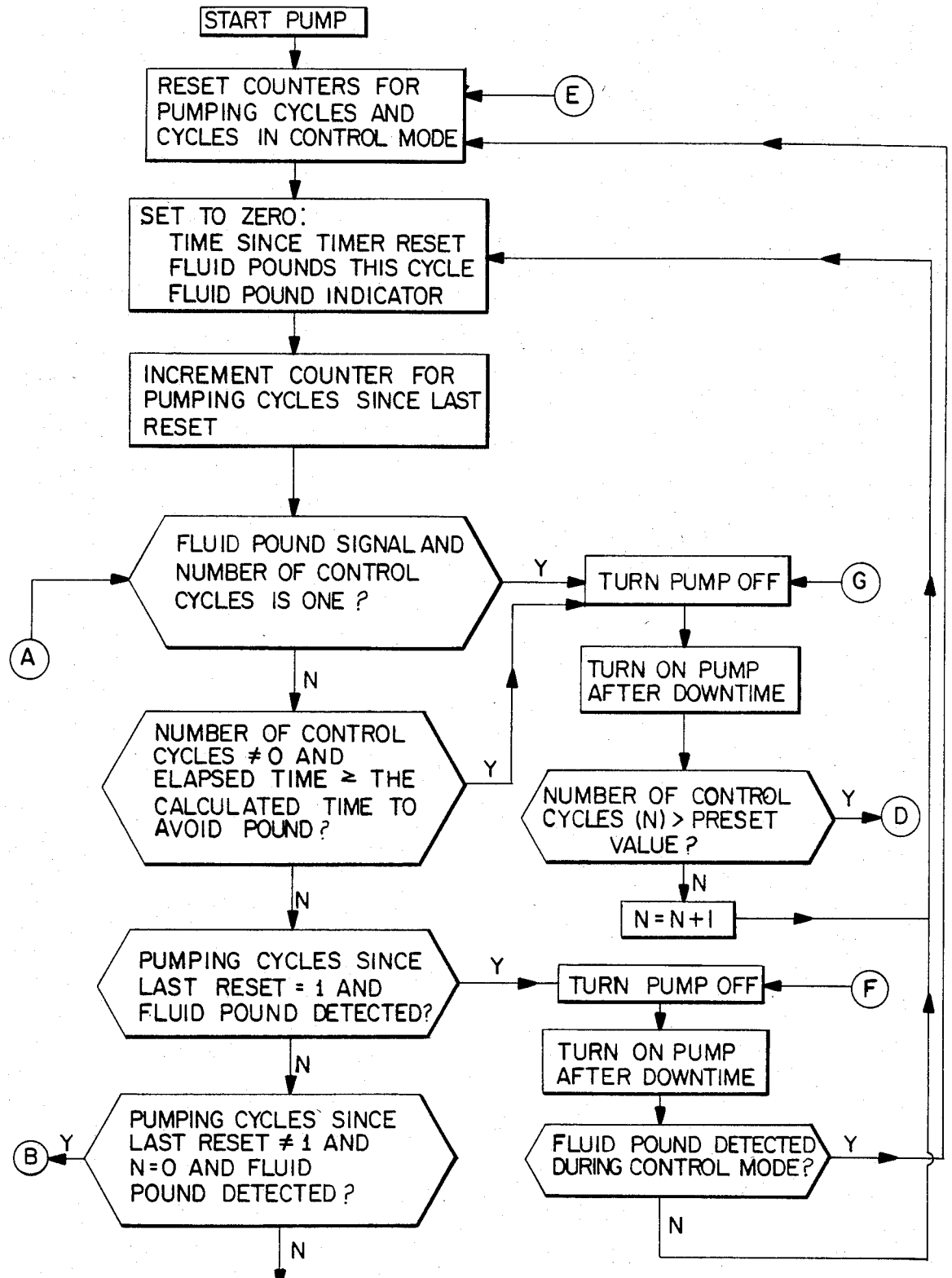
FIGS. 4A, 4B and 4C are flow charts illustrating the logic of the system operation of the present operation.
Figure 4B:
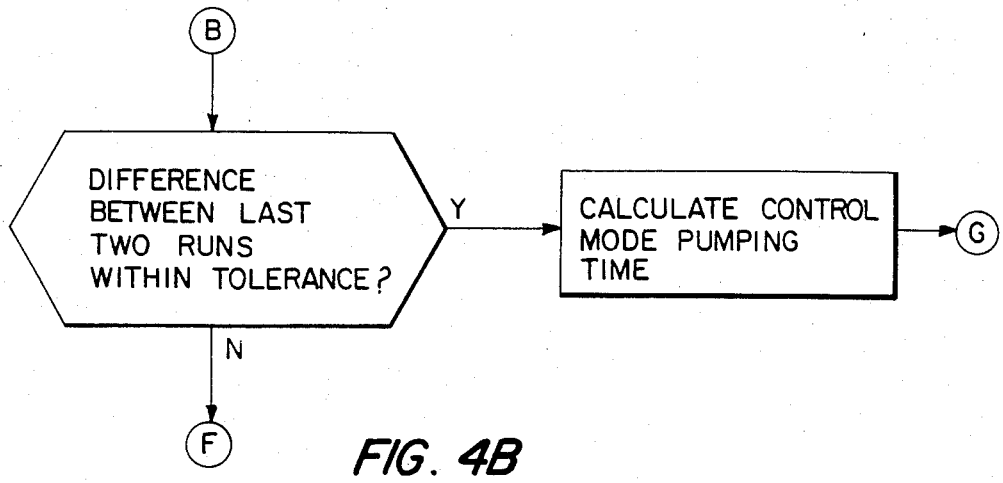
Figure 4C:
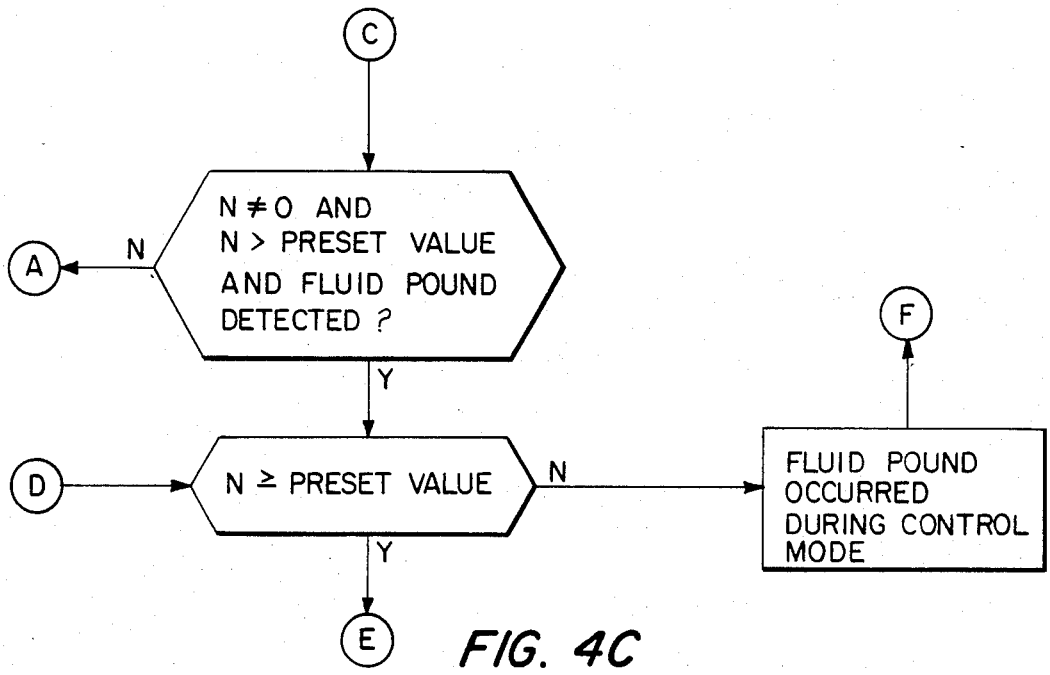
Figure 5A:
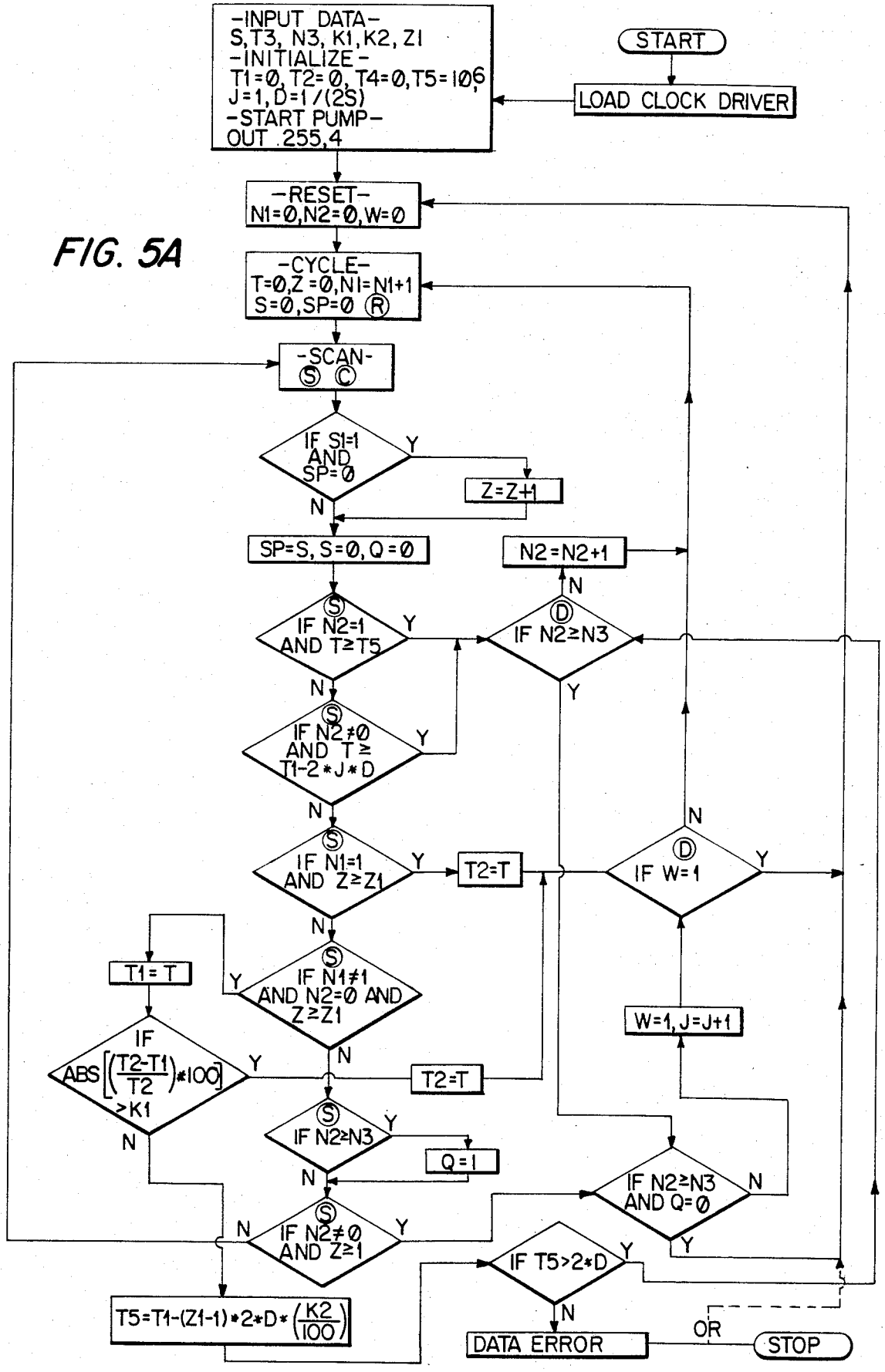
FIG. 5A is a flow chart of the program for the system of the present invention with FIG. 5B being a status subroutine, FIG. 5C being a check time subroutine, FIG. 5D being a reset time subroutine, and FIG. 5E being a downtime subroutine.
Figure 5B:
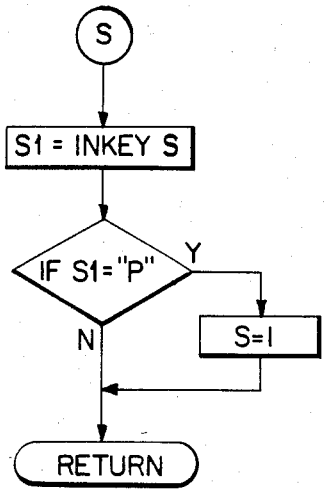
Figure 5C:
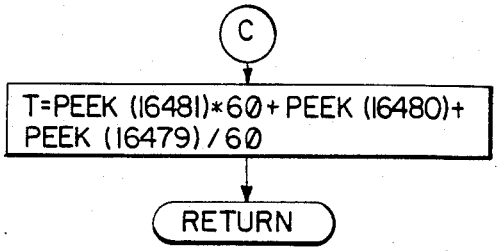
Figure 5D:
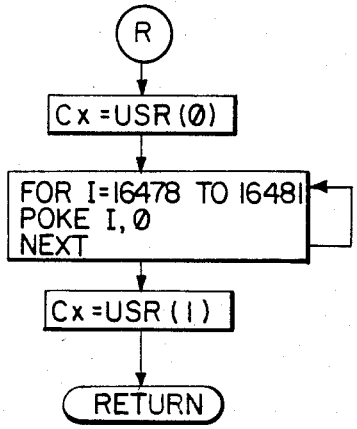
Figure 5E:
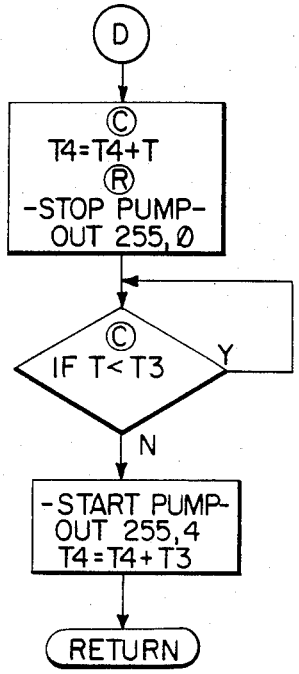

The down hole pumping mechanism illustrated in FIGS. 2 and 3 is of generally conventional construction and comprises a standing valve 34 mounted on the lower end of tubing 16 and a travelling valve 36 mounted for reciprocal movement within tubing 16. The standing valve comprises a lower seat 38, a ball 40 and a stop 42. The travelling valve is mounted in a housing 44 and includes a seat 46, a ball 48 and a stop 50.

During the upstroke of the down hole pump mechanism illustrated in FIG. 2, the fluid located in tubing 16 above travelling valve ball 48 is lifted causing ball 48 to seal against and close the opening defined by seat 46. Lifting of travelling valve 36 increases the volume 52 between the valves, causing reduced pressure therein into which fluid is drawn through standing valve seat 38, dislodging ball 40 from its seat and permitting fluid to pass into volume 52. During the downstroke illustrated in FIG. 3, housing 44 moves downwardly causing standing valve ball 40 to close the opening defined by its seat 38 and travelling valve ball 48 to move away from its seat 46. Such action causes the fluid that had previously been drawn into volume 52 to pass upwardly into housing 44 and out openings 54 in the upper portion thereof. During repeated strokes, the fluid will eventually pass up through tubing 16 and out wellhead 14 in the conventional manner.

Housing 44 is coupled at its upper end to a sucker rod 56, more than one of which can be coupled end-to-end to reach out of the top of the well. The upper end of the series of sucker rods is connected to horse head 24 by a wire-line hanger 58. Thus, pivoting movement of beam 48 generated by rotation of motor 32 cause the sucker rods 56 and housing 44 to reciprocate up and down within tubing 16 to pump fluids from the bore hole up and out of the wellhead.

When adequate fluid is flowing from the reservoir into casing 12, volume 52 will be completely filled during the entire upstroke of the pump. When volume 52 is completely filled at the completion of the upstroke, travelling valve 36 will be partially supported by the fluid in volume 52 on the downstroke. However, if insufficient fluid is flowing into the casing such that volume 52 is not completely filled at the completion of the upstroke, travelling valve 36 will remain closed until housing 44 contacts the fluid surface within volume 52. The contact of housing 44 with the fluid surface is known as "fluid pound". The fluid pound occurs as the sucker rods 56 are accelerating downwardly such that impact causes momentary compression of the rods sending strain waves and stress reversals throughout the sucker rod string. Such compression and stresses significantly increase the potential pump failure. Fluid pound is detected by monitoring the load on sucker rods 56.

Figure 6:
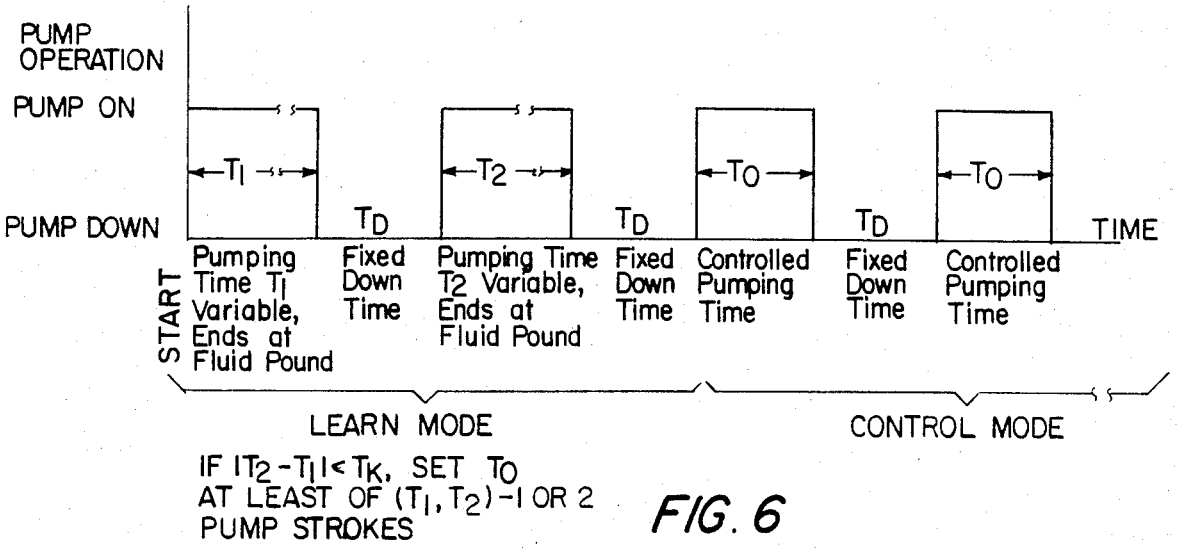
FIG. 6 is a graph illustrating pump operation as a function of time.

According to the present invention, the intermittent pumping of the well by the pump is controlled by sensor 60 and computer 62. Sensor 60 can be of the type disclosed in U.S. Pat. No. 3,851,955 to Mills, the disclosure of which is hereby incorporated by reference. Sensor 60 is a strain gauge transducer and produces an electric signal which is proportional to the load on sucker rod 56. The computer is coupled to the sensor by a multiconductor cable 61 and controls the pumping mechanism by signals supplied through a multiconductor cable 63 as set forth in the flow diagrams of FIGS. 4A–C and 5A–E, and in the graph of FIG. 6. The variables of FIGS. 5A–E are as follows, wherein S, $K_1$, $N_3$, $Z_1$, $N_4$ and $T_3$ are inputs:

| | |
|---|---|
| S | = Strokes per minute (2 digits) |
| $K_1$ | = Cycle stabilization tolerance (1 digit) |
| $N_1$ | = Number of pumping cycles since last reset |
| $N_2$ | = Number of pumping cycles since cycle stabilization |
| $N_3$ | = Stabilized cycles before reset (3 digits) |
| Z | = Number of fluid pounds this cycle |
| $Z_1$ | = Fluid pound limit before shut-down (1 digit) |
| W | = Abnormal fluid pound counter |
| J | = Number of back-off strokes (in program) |
| $N_4$ | = Initial number of back-off strokes (1 digit) |
| T | = Elapsed time since last timer reset |
| $T_1$ | = Total pumping time of present cycle |
| $T_2$ | = Total pumping time of previous cycle |
| $T_3$ | = Downtime (fixed, input) (3 digits) |
| $T_4$ | = Elapsed time since the beginning of run |
| $T_5$ | = Pump-off avoidance time |
| | $= T_1 - (Z_1 - 1) * 2 * D \times 0.99$ |

Upon manually starting the system, computer 62 operates in a sequence of two modes, a learn mode and a control mode. In the learn mode, test runs of the pump are made in which the pump is operated until a pump-off condition is achieved. The time (usually measured in minutes) of the test runs are then used to set the pumping time for the control mode operation such that the pump will be shut down just prior to the predicted occurrence of fluid pound for a predetermined time period. After a predetermined number of cycles in the control mode, the system returns to the learn mode for resetting the pumping time for the subsequent control mode operation.

In operation, the control system and the motor are manually started to commence pumping of the well as described hereinabove. The pump continues to run until sensor 60 detects a pump-off condition and generates a signal transmitted to computer 62 which shuts down motor 32. The time $T_1$ of the run is computed and the pump is maintained in a down condition for a preset time $T_D$ period, the duration of which has nothing to do with the length of the preceding run and can be, for example, 3 to 6 minutes in length. After the preset time period during which the pump is down, the pump is restarted and maintained on for time $T_2$ until another pump-off condition is sensed and a signal is transmitted by sensor 60 to the computer shutting the pump down for another preset time $T_D$. The pumping times $T_1$ and $T_2$ for the previous two pumping cycles are compared. If the difference between the two runs is within a preset tolerance $T_k$, the learn mode operation is complete. However, if the difference between the previous two runs is greater than the tolerance, the pump is operated through another test run until a pump-off condition is sensed and the run-time difference between the third and second is calculated. This sequence is iterated until the time difference between two consecutive test runs of the pump is less than the specified tolerance, whereupon the pump times are processed in the computer to set a pumping time $T_o$ for the control mode which is one or two strokes less than each of the two previous test runs.

After completion of the learn mode operation, the system is operated in a control mode. In the control mode, the pump is turned on and off for a predetermined number of cycles, e.g., 50 cycles. In each cycle, the pumping time is one or two strokes less than the test runs such that the pump will be turned off before a fluid pound occurs to avoid its deleterious effects. The off time for each cycle is preset for a specified down time. After the predetermined number of on-off cycles is completed, the system will automatically go into a "normal reset" in which operation returns to the learn mode operation described above.

The optimum number of control mode cycles depends on various factors, including the productivity index of the well and variations due to waterflood response. Typically, the number of control mode cycles is expected to be in the range between about 40 and about 100 cycles. A relatively large number of control mode cycles is preferred, without excessive fluid build up in the well annulus, to reduce cumulative fluid pound events.

The normal reset procedure permits the computer to adapt and reset the pumping time automatically to varying downhole conditions. Even without changes in the downhole flow conditions of the fluid being pumped, a small amount of fluid is accumulated during each control cycle due to pump shut-down before the occurrence of a pump-off condition, i.e., before all of the available fluid is pumped out. The operation in the learn mode will remove this accumulation.

Sensor 60 continues monitoring the sucker or polished rod load fluctuations during the control mode. Such continued monitoring causes the pump to be shut down upon the unexpected occurrence of a fluid pound. An unexpected fluid pound can occur due to a decline in production from the reservoir or a momentary consecutive increase in pumping time during the learn mode due to gas lock. Upon occurrence of fluid pound or a pump-off condition during control mode operation, the motor will be shut down for the preset period and the system operated in the learn mode to adapt the pumping time to the presently existing conditions.

The operation of the system of the present invention is illustrated by the following table summarizing results of field trails of the system:

| Test No. | Duration of Test (Hours) | Computer Control (Computer Controlled Cycles/Total Cycles) | No. of Cycles of Each Control Mode Operation | Average Pumping Time After Normal Reset (min.) | % Reduction in Fluid Pounds | Production (BBL/Day) Assuming 75% Efficiency Of Pump |
|---|---|---|---|---|---|---|
| 1 | 6.94 | 28/40 | 20 | | 70% | 35.0 |

-continued

| Test No. | Duration of Test (Hours) | Computer Control (Computer Controlled Cycles/Total Cycles) | No. of Cycles of Each Control Mode Operation | Average Pumping Time After Normal Reset (min.) | % Reduction in Fluid Pounds | Production (BBL/Day) Assuming 75% Efficiency Of Pump |
|---|---|---|---|---|---|---|
| 2 | 1.88 | 21/27 | 20 | 3.25 | 78% | 37.6 |
| 3 | 22.10 | 265/309 | 40 | 2.01 | 86% | 36.6 |
| 4 | 23.90 | 364/401 | 80 | 2.34 | 90% | 36.6 |
| 5 | 7.21 | 98/120 | 50 | 2.02 | 82% | 37.1 |
| 6 | 11.80 | 153/173 | 50 | 3.02 | 88% | 35.0 |

The preset downtime is the same for learn mode operation, and control mode operation. The time is selected to permit sufficient fluid build up in the casing annulus warranting starting of the pump, but to avoid reducing formation producting due to excessively high fluid column back pressure. The optimum downtime depends on the productivity index of the well. Short downtimes (e.g., 2 to 4 minutes) are used on high productivity index wells, while longer downtimes (e.g., 5 to 10 minutes) are used on lower productivity index wells. Productivity index is the ratio of a production rate change (usually barrels per day) to the pressure drawdown (usually in pounds per squae inch) required to produce the rate change.

Figure 7:
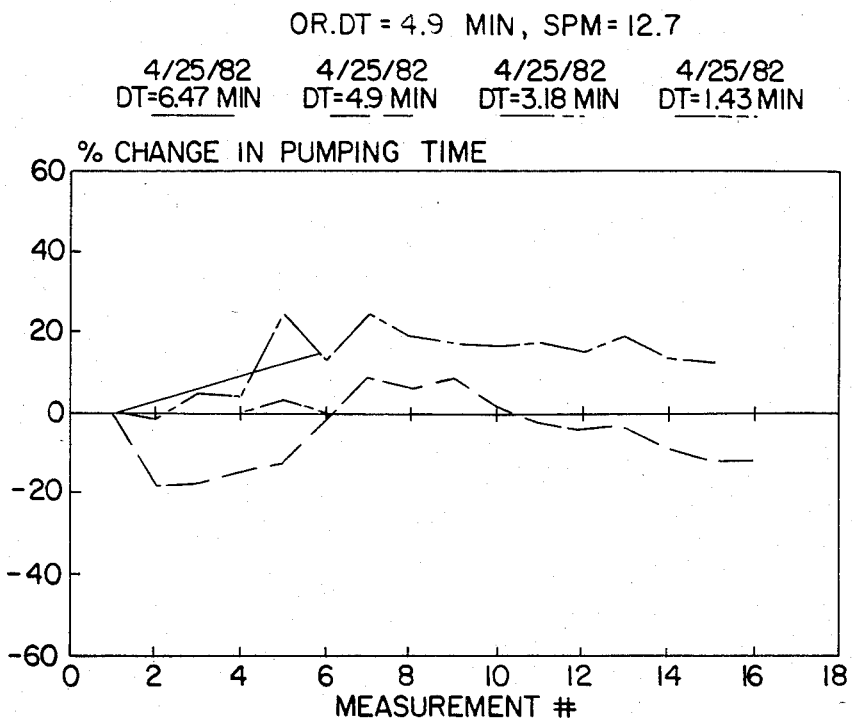
FIG. 7 is a graph illustrating percentage change in pumping time as a function of time.
Figure 8:
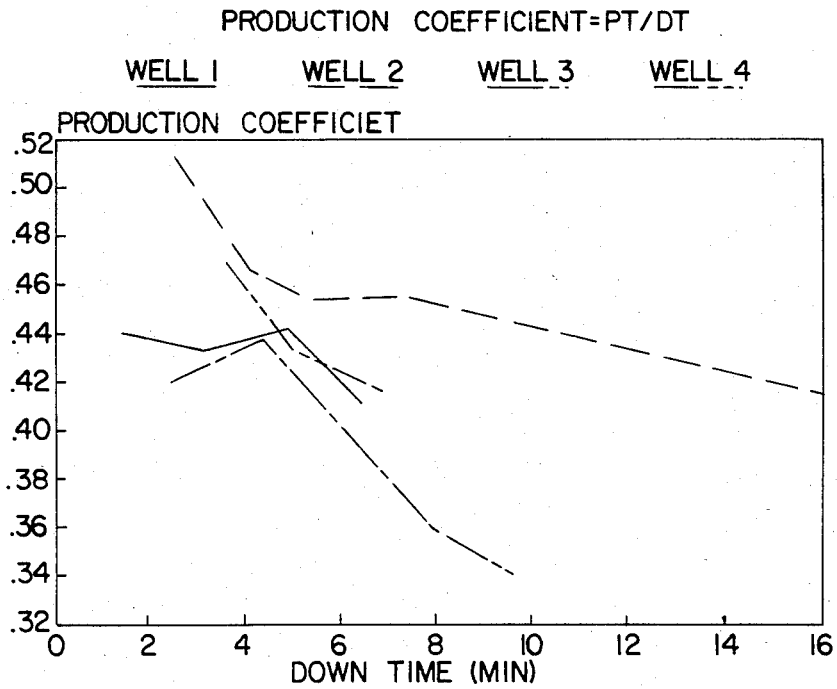
FIG. 8 is a graph illustrating production coefficient as a function of pump down time.

Generally, production increases with a corresponding decrease in the preset downtime. However, decreasing the prest downtime will increase the daily number of on-off cycles, and the number of fluid pounds experienced by the pumping mechanism. Since the system of the present invention reduces the number of fluid pounds by 70 to 90 percent, shorter downtimes can be employed to increase production. Downtime data is illustrated in FIGS. 7 and 8. FIG. 7 illustrates the percentage change in pumping time as a function of time in which the fluctuation was caused by gas lock. FIG. 8 illustrates production coefficient as a function of downtime, wherein the production coefficient is defined as the ratio of pumping time to down time. As illustrated in FIG. 8, the production coefficient increases as downtime decreases.

Thus, the system of the present invention for controlling the intermittent pumping of a well adapts itself to the gradual changes in reservoir conditions. The adaptability of the control to changing conditions is particularly important where the stability of the well is effected by gas lock, proximity to water injection wells, and injection rate variations. The system of the present invention predicts fluid pounds and shuts the pump down to avoid the fluid pound, but without loss in production.

The system has been found to be significantly advantageous in that it reduces fluid pound by 70 to 90 percent over conventional pump-off control systems and reduces fluid pound without reducing production. Additionally, production increases by using relatively short down times. Maintenance costs are lessened by reducing fatigue failures of rods and pumps resulting from fluid pounds. Moreover, the system can be simply and easily added to existing pump-off control systems.

Although the invention has been described in considerable detail with particular reference to a certain preferred embodiment thereof, variations and modifications can be effected within the spirit and scope of the invention as defined in the appended claims.

What is claimed is:

1. A method for automatically controlling the intermittent pumping of a well by a pump comprising the steps of:

A. operating the pump in a learn mode by pumping the well through at least two cycles, each cycle including a learn run and a preset deactivated time period;

B. terminating each learn run at pump-off;

C. determining the time difference between the time durations of the last two learn runs;

D. comparing said time difference to a predetermined tolerance;

E. operating the pump through another learn cycle and repeating steps A, B, C and D if said time difference exceeds said predetermined tolerance;

F. repeating steps A through E until said time difference is less than said predetermined tolerance;

G. thereafter operating said pump in a control mode by pumping the well through a predetermined number of cycles, each said last mentioned cycle including a production run and a preset deactivated time period;

H. providing a time duration for each said control mode production run less than the time duration of a learn run used in the most recent learn mode, whereby pump-off is avoided during normal pumping of the well in control mode; and I. setting the preset deactivated time periods used in said control and learn modes to be equal to each other.

2. The method of claim 1, wherein said predetermined number of control mode cycles is in the range of about 20 to about 80.

3. The method of claim 1, wherein pump operation is monitored to sense an unanticipated pump-off of the well during control mode operation; and deactivating the pump for a preset time upon the sensing of a said unanticipated pump-off.

4. The method of claim 3, wherein the learn mode is repeated after the pump has been deactivated during the control mode upon the sensing of a said unanticipated pump-off.

5. The method of claim 1, wherein said pump is a sucker rod pump, and wherein any pump-off of the well is detected by monitoring polished rod load fluctuations of said sucker rod pump.

6. The method of claim 5, wherein the decreased time duration of each production run as compared to each learn run is determined by operating said sucker rod pump for at least one stroke less in each production run as compared to the number of pump strokes in each learn run.

7. The method of claim 1, wherein said pump is periodically and automatically operated in learn mode after said predetermined number of production runs in control mode.

8. Apparatus for automatically controlling the intermittent pumping of a well by a pump comprising:

A. means for operating the pump in a learn mode by pumping the well through at least two cycles, each cycle including a learn run and a preset deactivated time period;

B. means for terminating each learn run at pump-off;

C. means for determining the time difference between the time durations of the last two learn runs;

D. means for comparing said time difference to a predetermined tolerance;

E. means for operating the pump through another learn cycle and for repeating use of the means A, B, C and D above if said time difference exceeds said predetermined tolerance;

F. means for repeating the use of means A through E until said time difference is less than said predetermined tolerance;

G. means for thereafter operating said pump in a control mode by pumping the well through a predetermined number of cycles, each said last-mentioned cycle including a production run and a preset deactivated time period;

H. means for setting each said control mode production run for a time duration less than the time duration of a learn run used in the most recent learn mode, whereby pump-off is avoided during normal pumping of the well in control mode; and I. means for setting the preset deactivated time periods used in said control and learn modes to be equal to each other.

9. The apparatus of claim 8, wherein said predetermined number of control mode cycles is in the range of about 20 to about 80.

10. The apparatus of claim 8, means to sense an unanticipated pump-off of the well during control mode operation; and means for deactivating the pump for a preset time upon the sensing of a said unanticipated pump-off.

11. The apparatus of claim 10, and means for repeating learn mode after the pump has been deactivated during the control mode upon the sensing of a said unanticipated pump-off.

12. The apparatus of claim 8, wherein said pump is a sucker rod pump, and wherein any pump-off of the well is detected by means for monitoring polished rod load fluctuations of said sucker rod pump.

13. The apparatus of claim 12, wherein the decreased time duration of each production run as compared to each learn run is determined by means for operating said sucker rod pump for at least one stroke less in each production run as compared to the number of pump strokes in each learn run.

14. The apparatus of claim 8, means for periodically and automatically operating said pump in learn mode after said predetermined number of production runs in control mode.

* * * * *